United States Patent [19]

Berglund

[11] Patent Number: 4,806,037

[45] Date of Patent: Feb. 21, 1989

[54] LIQUID WAX APPLICATOR

[76] Inventor: Joseph A. Berglund, 2319 Kirkwood La., Plymouth, Minn. 55441

[21] Appl. No.: 129,934

[22] Filed: Dec. 3, 1987

Related U.S. Application Data

[63] Continuation of Ser. No. 816,710, Jan. 7, 1986, abandoned.

[51] Int. Cl.[4] ..... A47L 13/22

[52] U.S. Cl. ..... 401/6; 401/140; 401/203; 401/204; 401/207

[58] Field of Search ..... 401/6, 138, 140, 196, 401/203, 204, 205, 206, 207, 270, 284

[56] References Cited

U.S. PATENT DOCUMENTS

| | | | |
|---|---|---|---|
| 1,068,719 | 7/1913 | West . | |
| 1,325,200 | 12/1919 | Kirsch . | |
| 1,714,350 | 5/1929 | De Jong | 401/207 X |
| 1,931,320 | 10/1933 | Haushalter . | |
| 2,187,671 | 1/1940 | Suddarth | 401/205 |
| 2,241,763 | 5/1941 | Bodimer | 401/284 |
| 2,731,656 | 1/1956 | Payne . | |
| 2,763,019 | 9/1956 | Huber . | |
| 2,768,401 | 10/1956 | Becker et al. . | |
| 2,817,105 | 12/1957 | Rubbo | 401/207 |
| 3,000,040 | 9/1961 | Carlson . | |
| 3,078,501 | 2/1963 | Thorman . | |
| 3,343,200 | 9/1967 | During . | |
| 3,410,517 | 11/1968 | Wall . | |
| 3,415,675 | 12/1968 | Allen . | |
| 3,713,744 | 1/1973 | Sims . | |
| 3,784,311 | 1/1974 | Failing . | |
| 3,785,001 | 1/1974 | Niemi et al. . | |
| 3,960,454 | 6/1976 | Schroeder, Jr. | 401/204 X |
| 4,134,697 | 1/1979 | Sparr, Sr. . | |
| 4,152,084 | 5/1979 | Melton et al. | 401/270 X |
| 4,357,779 | 11/1982 | Maddock | 401/204 X |

FOREIGN PATENT DOCUMENTS

| | | | |
|---|---|---|---|
| 2932110 | 2/1981 | Fed. Rep. of Germany | 401/140 |
| 96304 | 5/1960 | Norway | 401/205 |

*Primary Examiner*—Steven A. Bratlie

*Attorney, Agent, or Firm*—Merchant, Gould, Smith, Edell, Welter & Schmidt

[57] ABSTRACT

The present invention is directed to a wax applicator having a mop, a container for wax and mechanism for siphoning the wax between the container and the mop. A valve controls siphoning rate. The mop includes an applicator portion having a reservoir for receiving the wax with a plurality of openings for periodically distributing the wax from the reservoir to an applicator pad.

1 Claim, 2 Drawing Sheets

10
12
16
20
24
26
28
18
22
62
78
68
74
14
76
86
72
80
70

80
66
68
70
64
23
90
72
74

80
16
62
4
78
68
74
90
14
86
84
80
72
64
22
76
23
70

FIG. 4
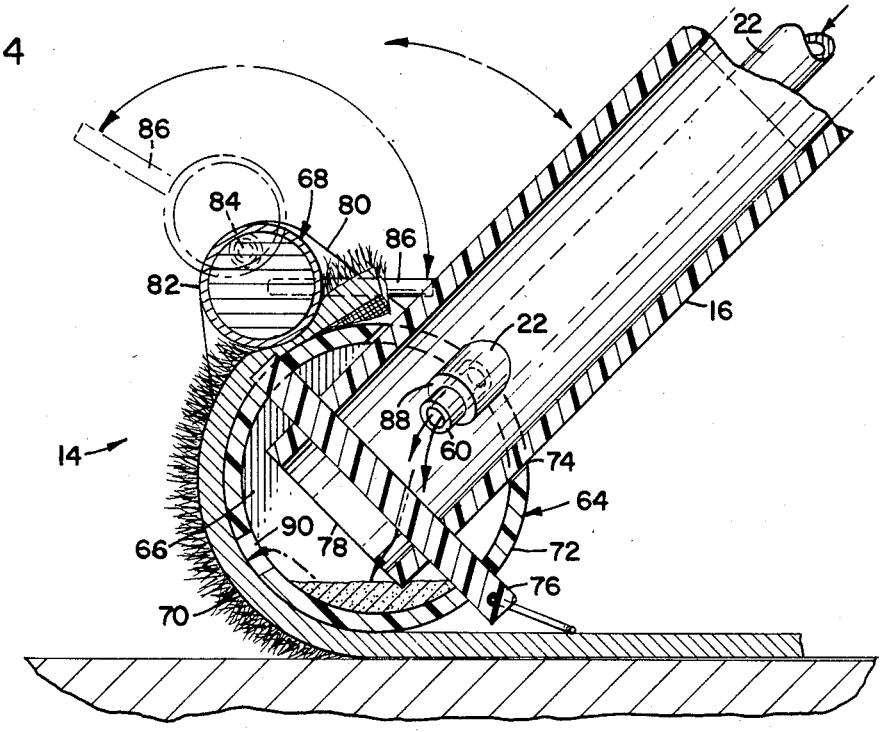
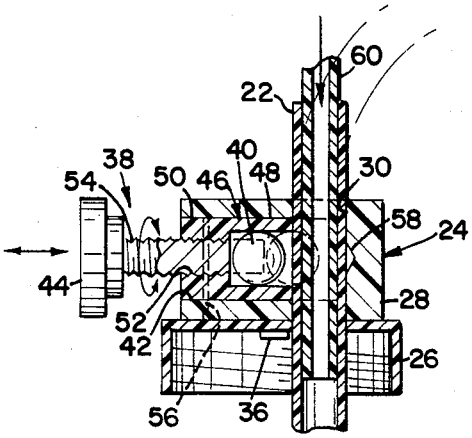
FIG. 5
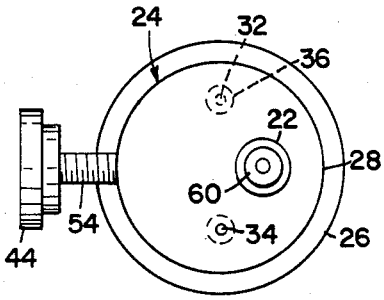
FIG. 6

LIQUID WAX APPLICATOR

This is a continuation of application Ser. No. 816,710, filed Jan. 7, 1986, now abandoned.

FIELD OF THE INVENTION

The invention is directed to cleaning devices for floors and, more particularly, to mop-like devices of a type having connected liquid dispensers.

BACKGROUND OF THE INVENTION

Hand held mops are, of course, well known. In using such a mop, it is common to pour a small puddle of wax on a floor and spread it about. Such a method is quite time consuming since the worker must continuously push the mop, pour wax from the container, push the mop, etc.

Other wax applicators are known which overcome the indicated problem. U.S. Pat. No. 2,768,401 is exemplary wherein a container is attached to a handled pad. Liquid wax runs through a hose from the container down to a location near the pad. Apparently, an amount of wax is released and the handled pad is moved about to spread the wax. Such mechanism is an improvement since it reduces the manual movements and splashing of wax which frequently occurs with the well known former method, yet such mechanism has created further problems by requiring a heavy and bulky container to be attached to the handle of the waxer pad. The applicator appears to be not only tiring and difficult to move about, but difficult to refill with wax unless a second person helps.

A somewhat similar wax applicator is shown in U.S. Pat. No. 3,784,311. An elongated container is mounted on a framework above the pad and along the handle. A mechanism for periodically rotating the container between wax dispensing and non-dispensing orientations is mounted to the handle. In the dispensing orientation, wax runs out of a plurality of openings to drop onto the floor. The applicator is then moved into the wax to spread it about the floor.

The present invention offers a much simpler and more practical solution for improving on the age-old method of waxing with a mop.

SUMMARY OF THE INVENTION

The present invention is directed to an apparatus for applying wax to a floor comprising a mop, having an applicator portion, a wax container, including a mechanism for attaching the container to a person; and a mechanism for siphoning wax from the container onto the applicator portion of the mop. A valve mechanism controls the flow of wax through the siphoning mechanism and provides a convenient and simple way to controllably move the wax from the container to the mop. The applicator portion of the mop includes an applicator pad and a mechanism for receiving wax from the siphoning mechanism and distributing the wax along the pad. The receiving and distributing means keeps the pad continuously wet with wax so that a uniform layer of wax may be continuously applied to the floor.

In one embodiment, a handled container is hooked about the belt of a worker. A tube extends from the bottom of the container upwardly through a valve cap mechanism and then across to the handle of the mop and downwardly to the applicator portion of the mop. The tube is fastened conveniently at one or more places along the handle of the mop. The valve mechanism is used to completely shut off flow to the mop or simply to regulate flow. The valve mechanism includes an opening between the interior of the container and the exterior atmosphere. The opening allows air to replace siphoned wax. The applicator portion includes a tubular reservoir into which wax is directed by the tube from the container. The reservoir is elongated and extends generally transversely from end to end of an applicator pad. A plurality of openings in the reservoir wall are regularly spaced along a transverse line. The line of openings is spaced upwardly from the usual bottom of the reservoir so that some wax accumulates in the reservoir and periodically empties through the opening onto the pad.

The present liquid wax applicator apparatus advantageously eases the work of using an ordinary hand held mop. With a container hooked to the belt of a worker and wax continuously and controllably flowing to the applicator portion of the mop, the worker can apply wax without stopping to pour wax, as required in the prior art. Furthermore, very little mechanism has been added to the mop, in contrast to the prior art, so that the mop is not burdensome to hold and move.

Wax is conserved. A valve not only provides for starting and stopping wax flow, but regulates flow rate so the applicator portion of the mop may be continuously moved to apply wax to unwaxed portions of the floor. Flow may also be stopped by lifting the applicator portion of the mop to the height of the wax container to stop the siphon action.

Wax is distributed evenly. The applicator portion of the mop includes a tubular reservoir which is attached to the handle of the mop. Wax from the container siphons into the reservoir at a steady, controlled rate. A plurality of openings in the sidewall of the reservoir upwardly from the bottom of the reservoir provide for wax to periodically escape from the reservoir to keep the applicator pad moist with wax so that the pad may be continuously moved about the floor to wax the floor. In this way, waxing is not only done rapidly, but is applied evenly.

These advantages and other objects of the present invention may be better understood by reference to the drawing and written description which follow.

BRIEF DESCRIPTION OF THE DRAWINGS

FIG. 4 is a cross-sectional view taken along line 4—4 of FIG. 2;

FIG. 5 is a cross-sectional view of the valve at the top of the container of a device in accordance with the present invention; and FIG. 6 is a top view of the valve.

DETAILED DESCRIPTION OF THE PREFERRED EMBODIMENT

Figure 1:
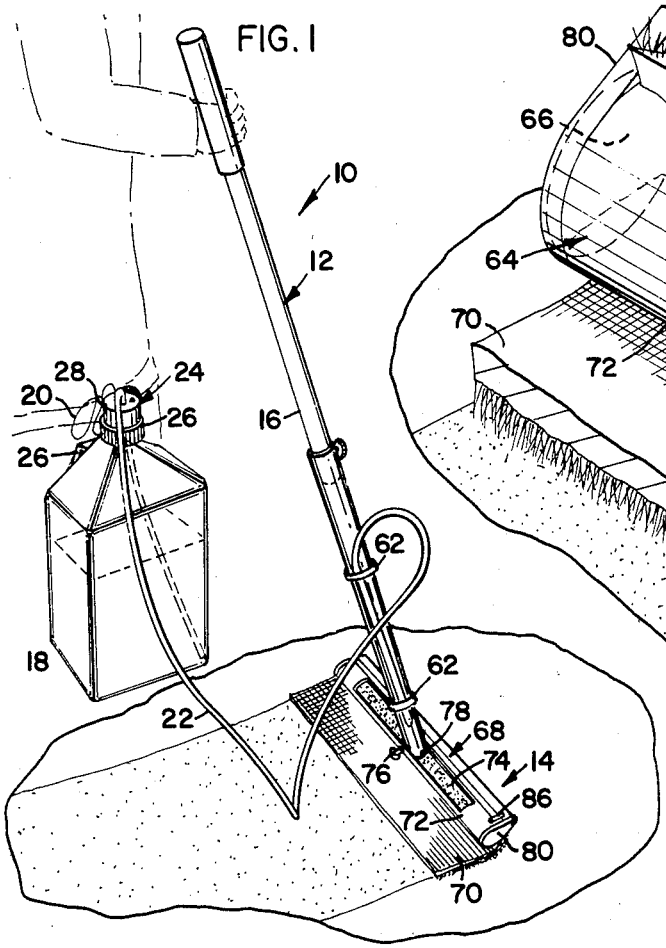
FIG. 1 is a perspective view of the wax applicator device in accordance with the present invention as used by the person shown in broken lines.

Referring now to the drawings wherein like reference numerals designate identical parts throughout the several views, and more particularly, to FIG. 1, an applicator apparatus in accordance with the present invention is designated generally as 10. Waxing apparatus 10 includes a mop 12 with an applicator portion 14 and a handle 16. A wax holding container 18 is attached to a person, most commonly at the belt, with a hanger 20. A wax communicating mechanism like tube 22 allows wax 23 within container 18 to be siphoned to flow through valve mechanism 24 to a location near applicator portion 14.

Container 18 is preferably made from plastic to offer relatively rigid structure, while yet allowing the operator to compress the sides as necessary. The shape of container 18 is not particularly important except that it has a handle 26 or other mechanism to which a hanger or the like may provide the connecting attachment to a person. Also, container 18 includes a threaded neck to which cap and valve mechanism 24 is attached.

As shown in FIGS. 5 and 6, mechanism 24 is attached to the top of a cap 26 and includes a housing 28. An opening 30 passes through the housing 28 and cap 26. Opening 30 receives tube 22 and communicates wax from container 28 to applicator portion 14 of mop 12.

Additional openings 32 and 34 pass through cap 26 and into housing 28. Opening 34 passes all the way through housing 28 as shown in FIG. 6. Pop rivets 36 hold cap 26 to housing 28. The insert for the pop rivet extending into opening 34 is removed so that the rivet has a hollow passage which aligns with the top of opening 34 thereby providing a vent for container 18, the vent passing through housing 28 and cap 26.

Valve mechanism 24 includes housing 28 with an adjustable pushing mechanism 38 for forcing ball 40 against tube 22. Opening 42 in housing 28 is generally cylindrical in shape and perpendicular to opening 30 for tube 22. Pushing mechanism 38 includes screw 44 held by insert 46. Insert 46 is cylindrical for being received in opening 42 and has a sleeve portion 48 for guiding ball 40. Insert 46 also has a body portion 50 with a threaded opening 52 for receiving the threaded portion 54 of screw 44. Insert 46 is held fixed within housing 28 by pins 56 pressed into openings (not shown) in housing 28 and grooves (not shown) in body portion 50 of insert 46. In this fashion, screw 44 may be turned with respect to insert 46 and housing 28 to force ball 40 inwardly or allow it to move outwardly. A detent 58 is formed in the wall of opening 30 opposite opening 42 to better crimp hose 22 as ball 40 is forced into it. It is preferable to include a smaller hose 60 in a friction fit within hose 22 where hose 22 passes through valve mechanism 24 to prevent the weight of the wax in hose 22 from causing hose 22 to fall as it leaves valve mechanism 24 thereby causing crimping. Also, the presence of hose 60 enhances resilience and helps hose 22 resist a permanent set due to ball 40 pinching hoses 22 and 60 closed. Ties 62 (see FIG. 1) hold hose 22 to handle 16 of mop 12 so as to position the output end 78 of hose 22 near applicator portion 14 of mop 12.

Figure 2:
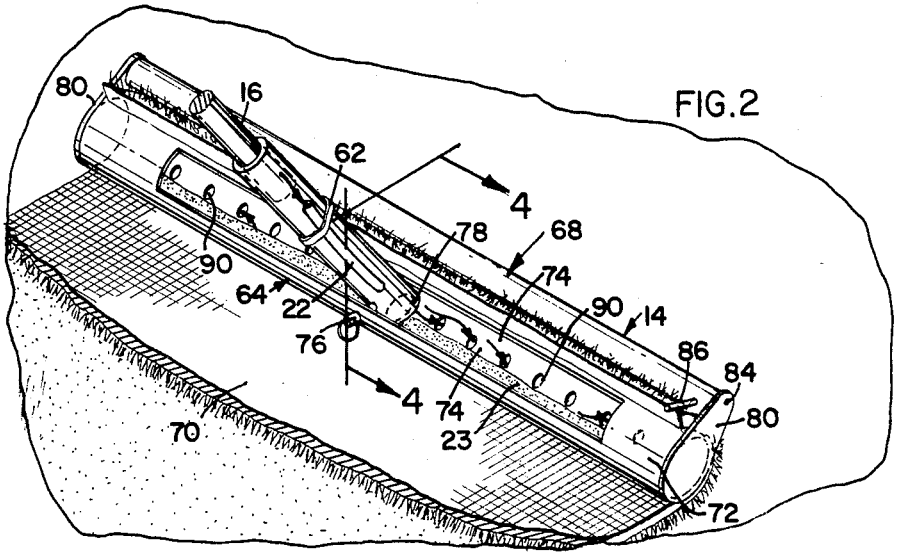
FIG. 2 is a larger perspective view of the applicator portion, showing also a portion of the handle.

As shown in FIG. 4, applicator portion 14 includes a reservoir 64 comprising a tube 72 with end members 66, which hold a clamp mechanism 68 for clamping applicator pad 70 to tube 72 of reservoir 64. Cylindrical tube 72 has an elongated rectangular slot 74 in its sidewall (see FIG. 2). Slot 74 has sufficient width to readily receive the end 78 of handle 16. Slot 74 has sufficient length so that the interior of tube 72 is easily cleaned. A pin 76 passes perpendicular to the axis of tube 72 through tube 72. Pin 76 also passes through the end 78 of handle 16 (which is inserted through rectangular opening 74) in a direction perpendicular to the axis of handle 16. Pin 76 may be removable, as shown, or it may be fixed to tube 72. If pin 76 is removable, it should be placed at an angle such that it bumps against rod 82 of clamping mechanism 68 at one end and is retained by applicator pad 70 and the floor at the other end when the mop is inclined in its usual operating orientation. Pin 76 should have at least a slight friction fit in the openings of tube 72. Handle 16, on the other hand, should be free to rotate on pin 76 so that handle 16 may be inclined in slot 74 as applicator portion 14 is moved from side to side.

Each end member 66 covers a particular end of tube 72 and also has an outwardly extending portion 80 extending beyond tube 72. The centerline of portion 80 forms somewhat less than a right angle with handle 16. A clamp member, preferably cylindrical rod 82 is rotatably fastened between portions 80. Rod 82 is fastened along a diameter which is approximately perpendicular to a tangent line to tube 72 which forms reservoir 64. The fastening mechanism may be a pair of screws 84 (see FIG. 2) or an equivalent mechanism about which rod 82 may be moved rotationally. A lever 86 is fastened to rod 82 to extend outwardly therefrom so that it is convenient to grasp to move rod 82 in rotation. When the outer surface of rod 82 is rotated close to tube 2, applicator pad 70 is pinched therebetween and held securely. In that orientation, lever 86 is in contact with or nearly in contact with tube 72 to prevent further rotation of clamping rod 82. Applicator pad 70 wraps forwardly from the clamping relationship between rod 82 and tube 72 around tube 72 to trail rearwardly behind tube 72 to provide material for spreading wax on the floor.

As indicated previously, wax is directed from container 18 through tube 22 to reservoir 64. Although tube 22 may be fastened to handle 16 so that wax flows from the end of tube 22 through opening 74 into reservoir 64, it is preferable to pass the end 88 of tube 22 through the wall of handle 16 into a hollow portion so that wax flows from end 88 through the bottom portion of handle 16 into reservoir 64.

Figure 3:
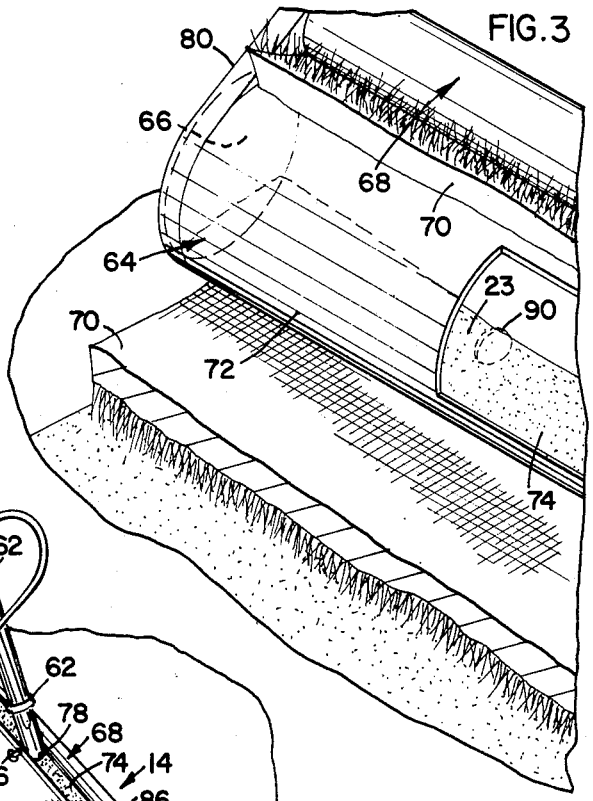
FIG. 3 is a still more enlarged perspective view of one end of the applicator portion.

Tube 72 which forms a cylindrical wall for reservoir 64 includes a plurality of openings 90 through which wax moves to wet pad 70. Openings 90 are regularly spaced between the end members 66 of tube 72 and are centered on a radial plane of tube 72. When handle 16 is vertical, the radial plane on which openings 90 are centered is inclined somewhat with respect to the vertical in the direction of clamping mechanism 68. In other words, openings 90 are aligned along a first line spaced from a second line which forms the bottom of reservoir 64 when handle 16 is vertical. Thus, when handle 16 is tilted in its usual operational orientation so that clamping mechanism 68 is rotated near the uppermost part of reservoir 64, openings 90 are located several degrees forwardly and upwardly on the cylindrical wall of tube 72. In this way, wax accumulates in the lowermost portion of tube 72 between ends 66. As the mop 12 is moved about, wax empties from reservoir 64 through openings 90 during various normal motions. When handle 16 is tilted toward the vertical, openings 90 are moved toward the bottom of reservoir 64 and wax in reservoir 64 moves toward and fills openings 90. Each opening 90 then acts as a smaller reservoir until the wax soaks into pad 70. In addition, as the mop 12 is moved from side to side, wax rushes from one end of tube 72 to the other as indicated in FIG. 3. During a change of direction, a swell of wax rises to flow into many of openings 90 thereby wetting that portion of pad 70. It is apparent that opposite sides of pad 70 are occasionally wetted in this manner.

In use, wax filled container 18 is attached to a person with hanger 20. With the mop in a waxing position and the vent opening 34 closed with a finger, container 18 is squeezed to force wax through tube 22 to empty into reservoir 64. The vent opening 34 is opened and wax continues to flow from container 18 to reservoir 64 due to a syphoning effect. The rate of flow is controlled by valve mechanism 24 whereby screw 44 may be turned to force 40 to constrict tubes 22 and 60. Flow may be completely stopped by moving screw 44 inwardly toward detent 58 until ball 40 completely closes tubes 22 and 80. A second way to stop flow is to simply lift the applicator portion 14 of mop 12 above the level of container 18 thereby stopping the syphoning effect.

As mentioned, wax flows through tube 22 and out end 88 and end 78 of handle 16 into the lowermost portion of tube 72 of reservoir 64. If mop 12 is not moved, wax would accumulate to a level which would allow it to run into openings 90 thereby flowing out of reservoir 64 to wet pad 70. When in use, however, mop 12 is being moved back and forth and most preferably in a figure eight type movement. In this way, wax rises and ebbs alternately at each end and, consequently, rises to openings 90 on one side of the mop to wet one side of applicator 70 during a portion of the movement and then ebbs on that side only to rise on the other side and similarly wet the other portion of the pad. Also, as the handle 16 is tilted forwardly wax flows out of all of openings 90 at the same time to wet pad 70 along its entire transverse length.

As mentioned, waxing is readily interrupted by lifting applicator portion 14 to stop the syphoning action, by pinching tube 22, or by turning in screw 44. Apparatus 10 is easily cleaned at the end of a waxing job by unscrewing container 18 from cap 26 and emptying any unused wax and washing container 18. Similarly, water may be run through tube 22 and valve mechanism 24 may be washed off. Slot 74 provides for easy wiping of the entire interior of reservoir 64. Applicator pad 70 is readily removed by moving lever 86 away from tube 72 thereby rotating rod 82 away from a clamping relationship with tube 72.

The present invention thus is an advance in the well known, long established floor waxing procedure. The present invention eliminates the need of pouring wax onto a floor before spreading it about the floor with a mop. The present invention continuously and controllably provides wax to an applicator pad for continuous and uniform application to the floor, and although the advantages and details of structure and function of the invention have been set forth at length, they are nevertheless understood to be exemplary. Therefore, any changes made, especially in matters of shape, size and arrangement of parts to the full extent extended by the general meaning of the terms in which the appended claims are expressed, are within the principle of the invention.

What is claimed is:

1. Apparatus for applying wax to a floor, comprising:

a wax container;

means for attaching said container to a person;

means for applicating wax to said floor, said applicating means including an applicator pad and a handle, said applicating means also including an elongated reservoir with a cylindrical wall and means for attaching said pad to said reservoir, said applicating means further including a slot in the cylindrical wall of said reservoir, said handle having a lower end fitted in said slot, said reservoir and said handle each having an axis, said applicating means still further including means for pivotably attaching said handle to said reservoir, said handle attaching means having a pivot axis, said pivot axis being perpendicular to said axes of said reservoir and said handle, said reservoir including means for emptying only a portion of wax therein onto said pad depending on movement of said pad and reservoir while waxing said floor, said emptying means including a plurality of openings regularly spaced in an axial direction along said cylindrical wall, said openings being aligned along a first line spaced forwardly from a second line which forms the bottom of said cylindrical reservoir when said handle is vertical; and means for adjustably directing wax from said container to said reservoir.

* * * * *